United States Patent [19]

Babb, Jr. et al.

[11] 4,156,541

[45] May 29, 1979

[54] LOCK ASSEMBLY

[75] Inventors: John H. Babb, Jr.; Robert A. Marotto, both of Grand Rapids, Mich.

[73] Assignee: Kysor Industrial Corporation, Cadillac, Mich.

[21] Appl. No.: 826,923

[22] Filed: Aug. 22, 1977

[51] Int. Cl.[2] ..... E05C 9/06; E05B 63/14

[52] U.S. Cl. ..... 292/21; 70/92; 70/108; 292/34; 292/DIG. 65

[58] Field of Search ..... 292/21, 33-36, 292/DIG. 65, 37, 27, 46, 47, 49; 70/107-109, 118, 92, 465

[56] References Cited

U.S. PATENT DOCUMENTS

| | | | |
|---|---|---|---|
| 1,277,174 | 8/1918 | Bakst | 70/108 |
| 1,346,143 | 7/1920 | Teich | 70/108 |
| 1,368,141 | 2/1921 | Hagstrom | 292/34 |
| 2,188,532 | 1/1940 | Dominguez | 70/108 |
| 3,910,612 | 10/1975 | Guirand | 292/33 |
| 3,999,789 | 12/1976 | Maurits et al. | 292/36 X |

*Primary Examiner*—Roy D. Frazier
*Assistant Examiner*—William E. Lyddane
*Attorney, Agent, or Firm*—Price, Heneveld, Huizenga & Cooper

[57] ABSTRACT

An interconnecting lock assembly having simultaneously actuated, multiple security deadbolts, the central one forming part of the main lock subassembly, and the others being operated from the main lock subassembly through special mechanism.

5 Claims, 19 Drawing Figures

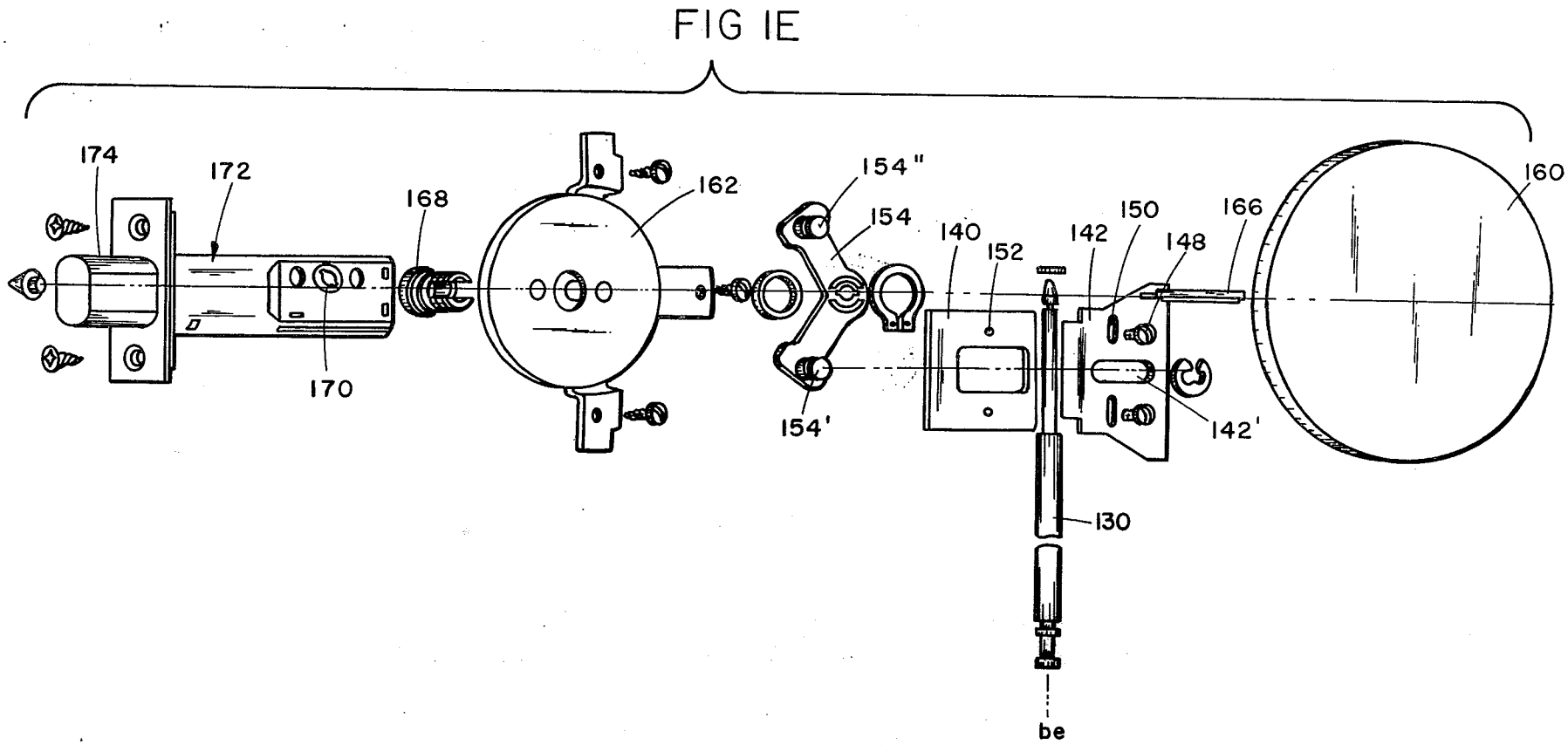
FIG IE

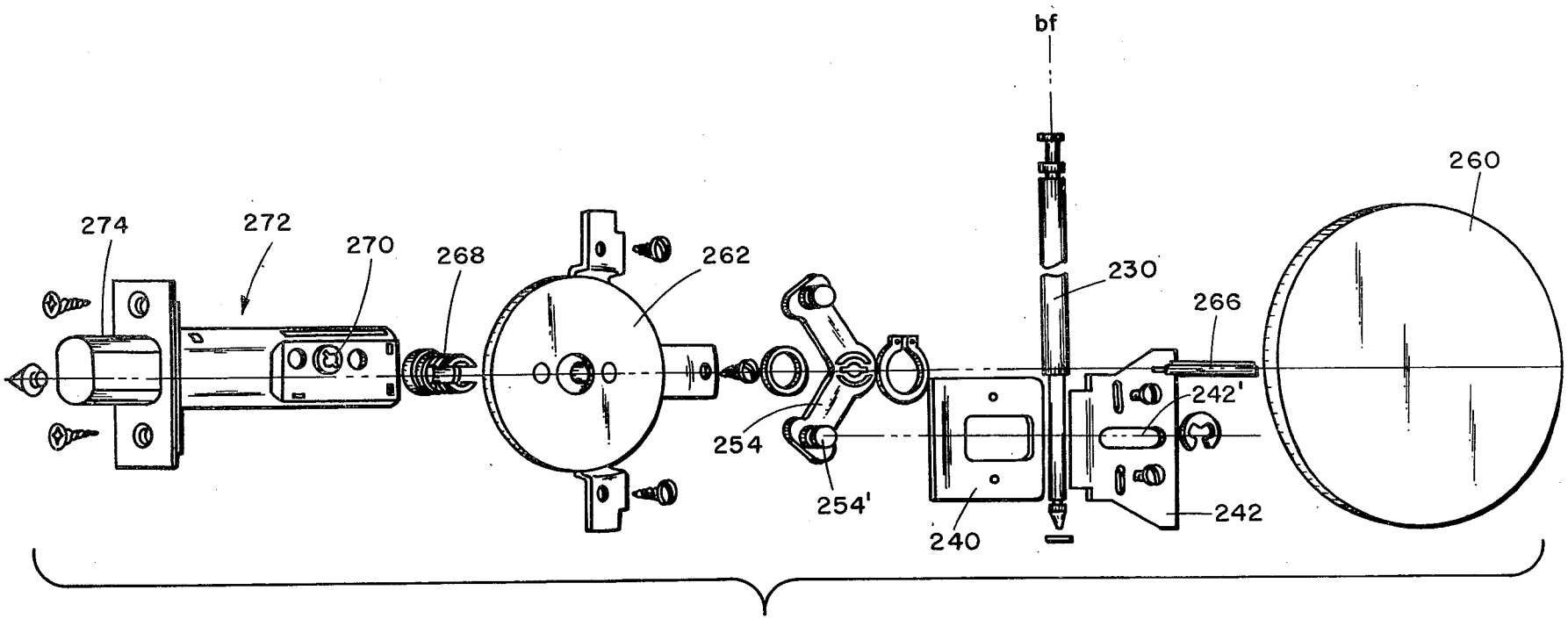
FIG IF

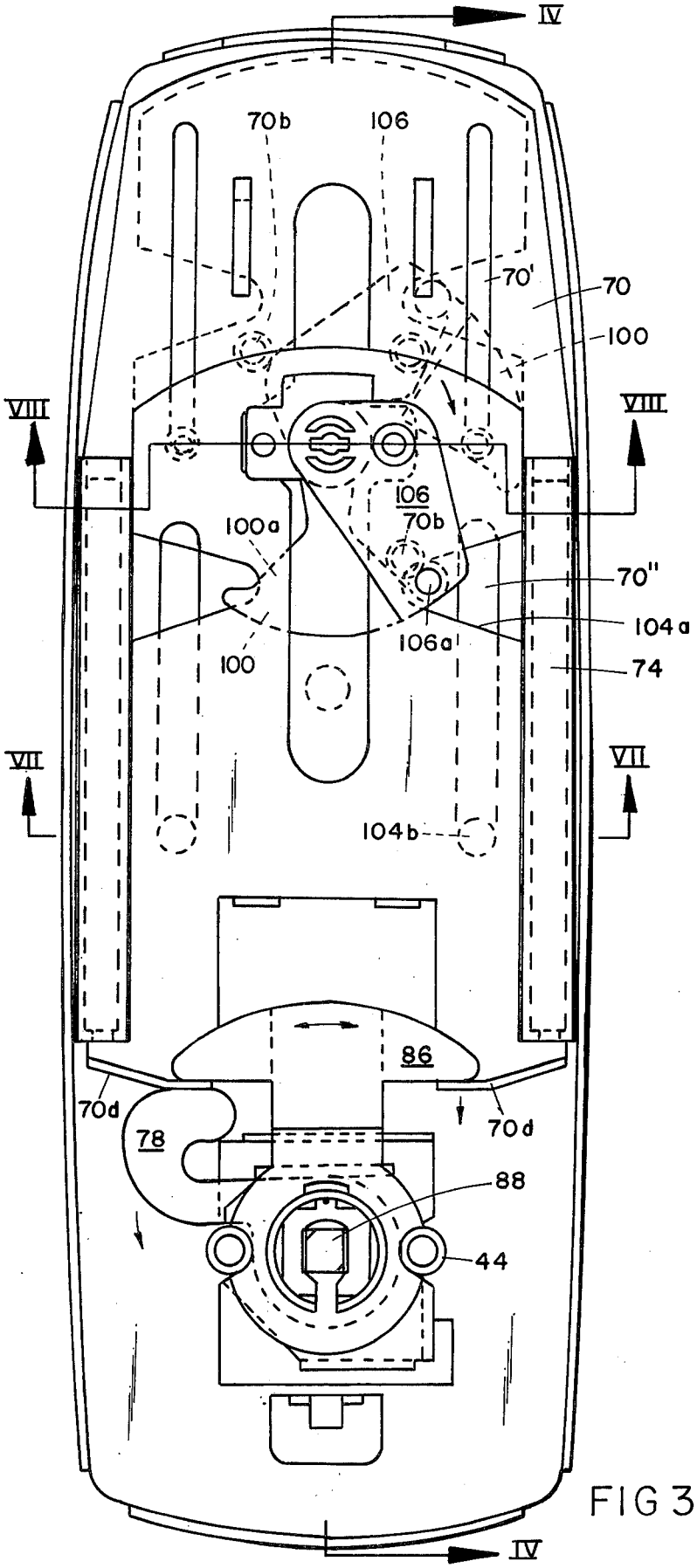
FIG 3
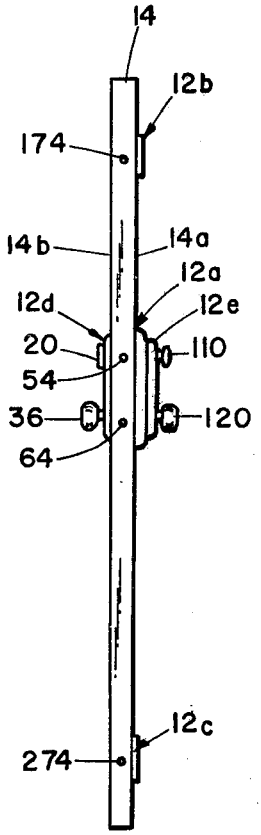
FIG 2
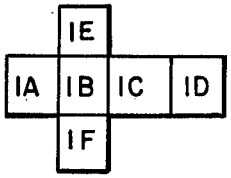
FIG IG

LOCK ASSEMBLY

BACKGROUND OF THE INVENTION

This invention relates to a door lock assembly, and particularly to one effecting added security with simultaneously actuated multiple security deadbolts, while allowing panic exit.

The increasing frequency of unauthorized entry in recent years has led to use of more effective security deadbolt equipment on doors. One example is a longer deadbolt. Another example is the installation of more than one deadbolt on the door. These do offer greater security, but can also cause potential danger, especially the multiple deadbolt unit as in the event of a panic situation such as fire. Persons within the building or enclosure can be trapped by lack of time and/or ability to open all of the deadbolts. Actually, if multiple security deadbolts are used, they should be arranged with a security bolt opposite each door hinge. Then, attempts to pry the door at the deadbolt will be resisted by the respective hinge assembly. By doing this, however, one of the deadbolts will typically be out of reach of smaller persons such as children, so as to be difficult or even impossible to operate.

SUMMARY OF THE INVENTION

This invention effects a multiple deadbolt, interconnecting lock assembly enabling special security deadbolts to be positioned opposite to and aligned with each of the door hinges, yet capable of operation through the main lock subassembly and of being released simultaneously by actuation of the inner knob, as for a panic exit. Further, all of the deadbolts can be locked simultaneously, using an inner turnpiece or an outer key, and can be unlocked in like fashion.

The novel apparatus combines the unique features of the assembly in U.S. Pat. No. 3,999,789 with special mechanism to simultaneously operate auxiliary deadbolt subassemblies during actuation of the main lock subassembly. As a result, all of the advantages of the patented apparatus are realized as well as added security from the auxiliary deadbolts opposite the hinges, yet allowing panic exit by simultaneous release of all of the deadbolts plus the latch bolt by merely rotating the inner knob. The total assembly can be employed on right or left-hand doors with equal facility.

Unique mechanism is employed between the main lock subassembly and the auxiliary lock subassemblies to effectuate dependable, readily activated mechanism. The interconnecting devices to the auxiliary deadbolt subassemblies also enables alteration of the amount of the throw of the auxiliary deadbolts to assure full extension for locking.

These and other objects of this invention will become apparent upon studying the following specification in conjunction with the drawings.

BRIEF DESCRIPTION OF THE DRAWINGS

FIG. 1*a*–1*f* is an exploded perspective assembly view of the preferred version of the apparatus;

FIG. 1*g* is a diagram showing how the drawing sheets for FIGS. 1*a*–1*f* should be positioned for viewing of the assembly;

FIG. 2 is an end elevational view of a door employing the apparatus of FIG. 1*a*–1*f*;

FIG. 3 is an elevational view of the actuating mechanism of the main lock subassembly of the apparatus in FIG. 1*a*–1*f*;

DESCRIPTION OF THE PREFERRED EMBODIMENTS

Referring now specifically to the drawings, the apparatus in FIGS. 1–8 will be described first. The apparatus in FIGS. 1–8 differs from that in FIGS. 9–13. Both have multiple security deadbolts, a main lock subassembly having a latch bolt and a security deadbolt, and auxiliary lock assemblies having security deadbolts, interconnecting mechanism between the main lock subassembly and the auxiliary lock subassemblies, simultaneous operation of the multiple deadbolts, capacity for panic exit with release of the latch bolt and all deadbolts by operation of only the inner knob, and projection of the deadbolts and latch bolt through the edge of the door. The apparatus in FIGS. 1–8 has an interconnect mechanism between the main lock subassembly and the auxiliary lock subassemblies within the structure of the door itself. The apparatus in FIGS. 9–13 has a different interconnect mechanism, on the inside face of the door, preferably covered by a dress cover thereover.

Figure 1A:
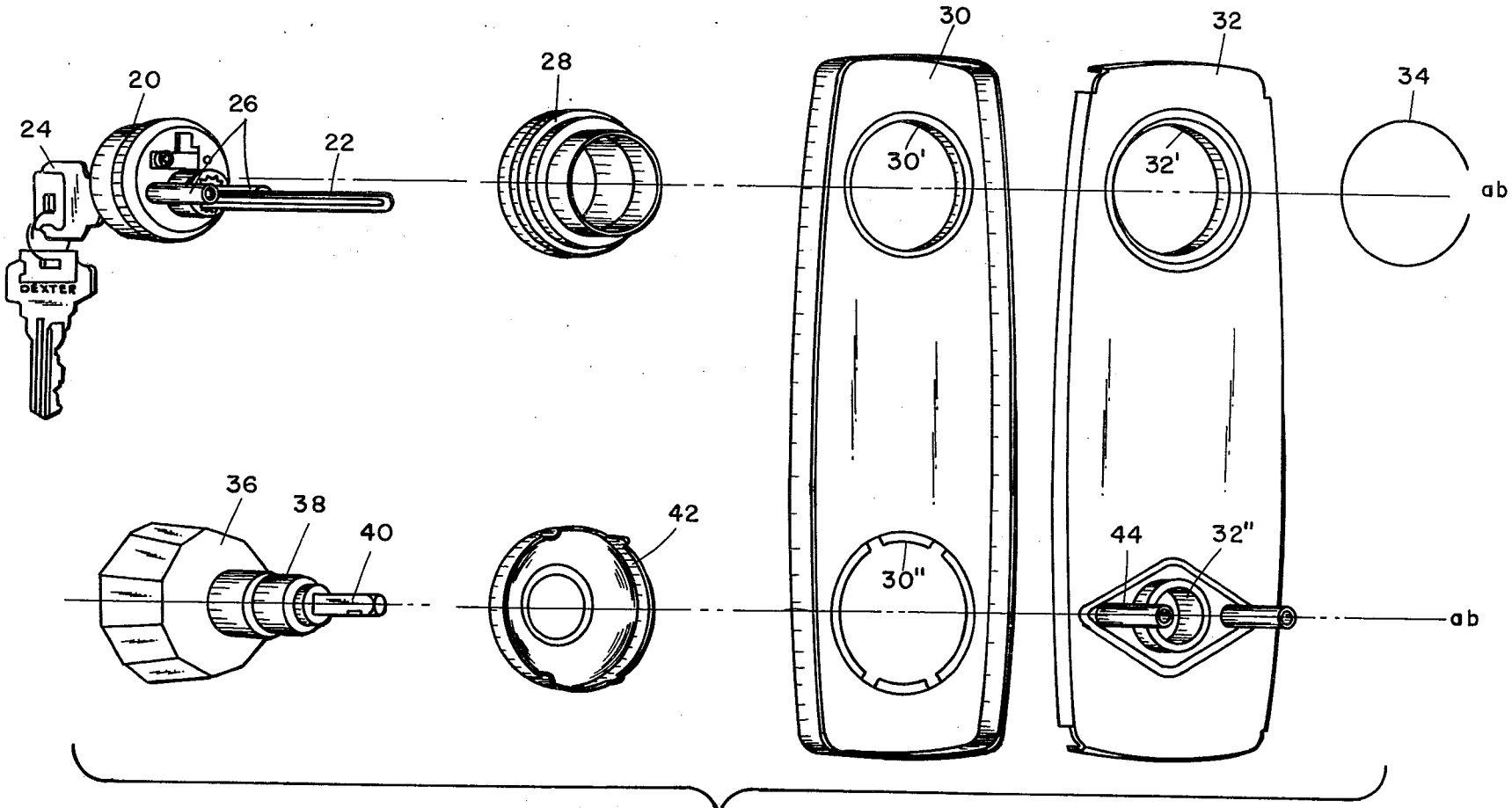

Referring now specifically to the drawings, the arrangement of the drawing sheets for the exploded view set forth in FIGS. 1*a*–1*f* is shown in FIG. 1*g*, it being intended that lines ab, bc, cd, be, and bf should be aligned with lines bearing like indicia on the adjacent sheet. Assembly 10 depicted in FIGS. 1 and 3–8 includes a lock assembly 12 mounted on and within a door 14 that includes a typical door frame (not shown) having a hinge post and latch post. In this depicted embodiment, a left-hand door arrangement is set forth, i.e. with the hinges on the right as viewed from the inside of the door. It will be understood from the descriptive material set forth hereinafter that the lock is equally usable in a right-hand door arrangement. The door post would include a latch plate of conventional type to allow entry of a latch bolt into a recess in the door post. Further, the door post would include a deadbolt plate with an opening for each deadbolt in the lock assembly.

The lock assembly includes the main lock subassembly 12*a* (FIG. 2) and auxiliary lock subassemblies 12*b* and 12*c*. Main lock subassembly 12*a* includes an inner subassembly 12*e* and an outer subassembly 12*d* on the respective inside and outside faces 14*a* and 14*b* of door 14.

Figure 4:
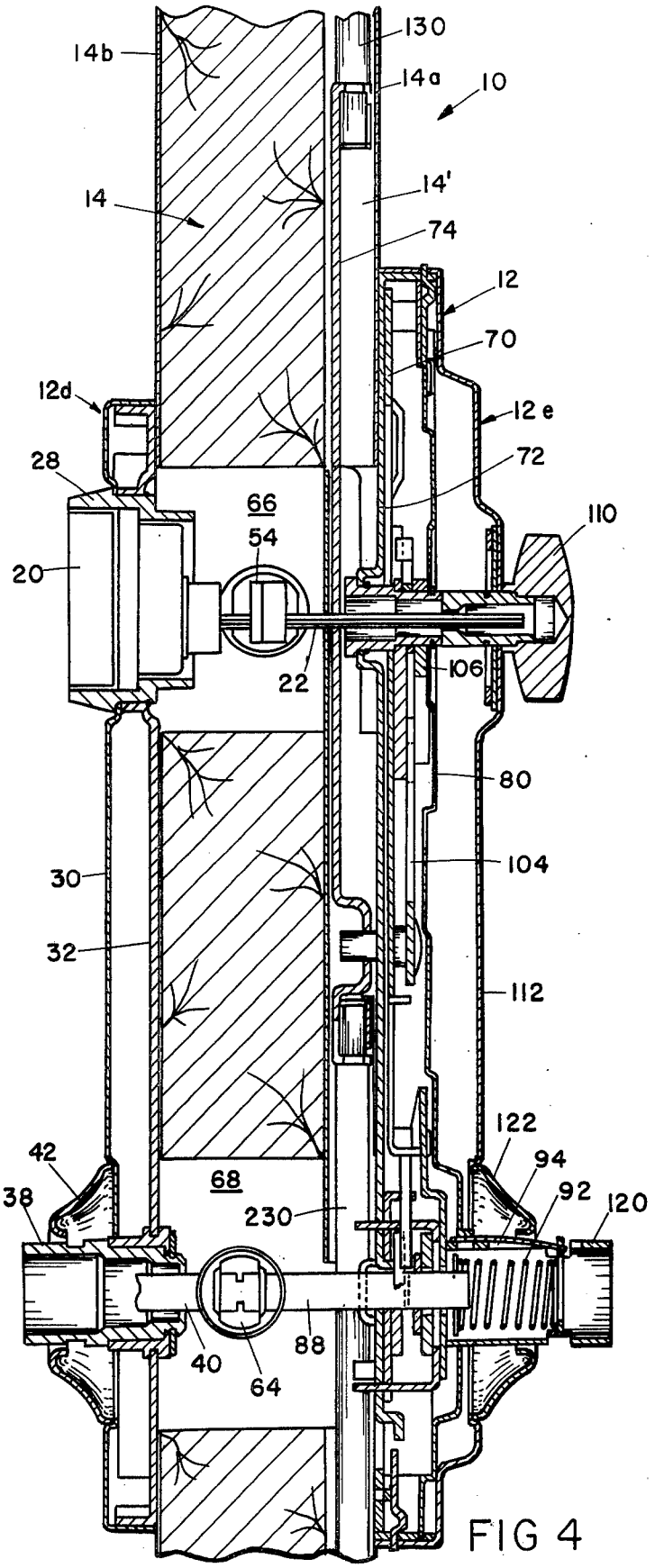
FIG. 4 is a sectional elevational view of the main lock subassembly, taken on plane IV—IV of FIG. 3, in combination with a door.
Figure 13:
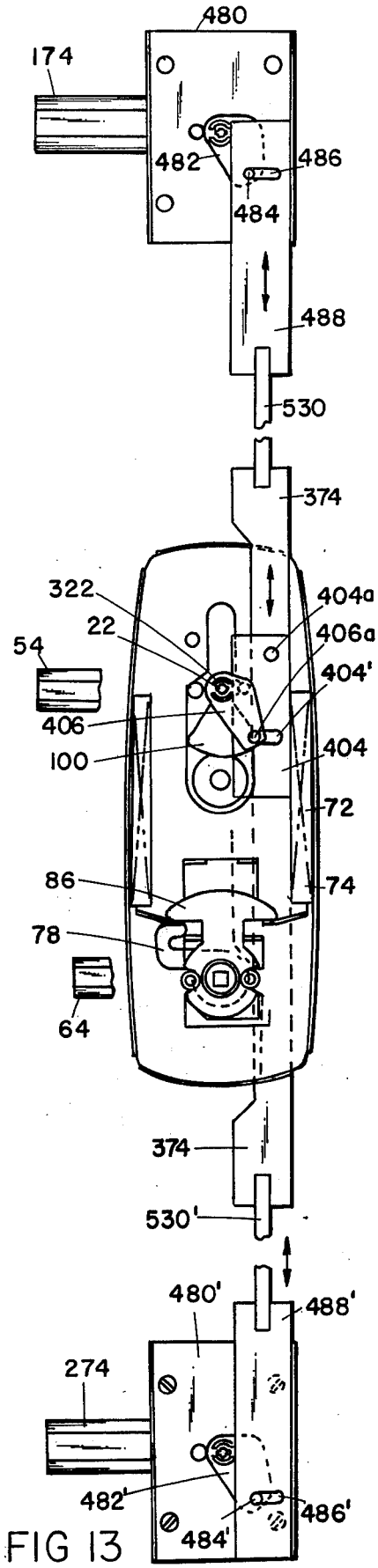
FIG. 13 is a side elevational view of the apparatus in FIG. 12 without the door.
Figure 5:
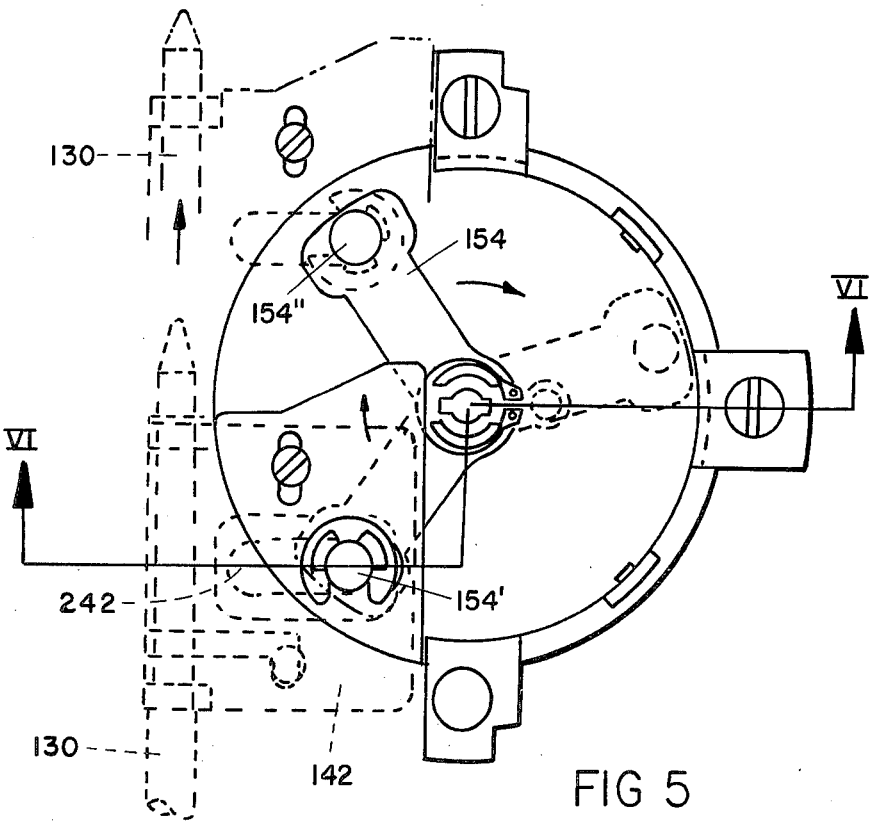
FIG. 5 is an elevational enlarged view of one of the auxiliary lock subassemblies in the apparatus of FIG. 1.
Figure 6:
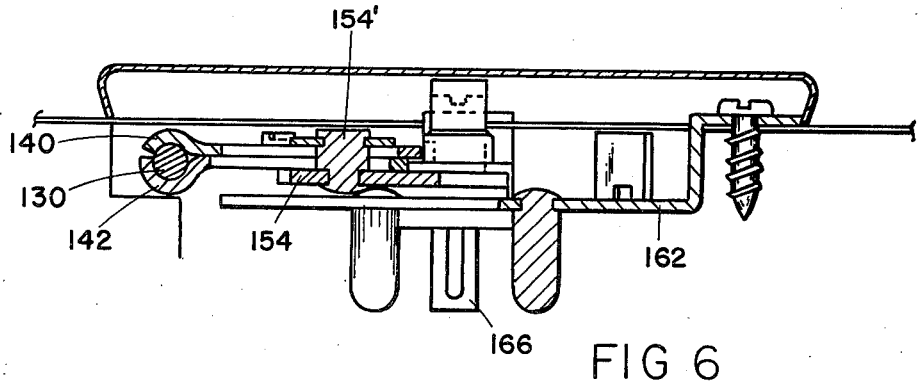
FIG. 6 is a sectional view of the apparatus in FIG. 5, taken on section planes VI—VI.
Figure 7:
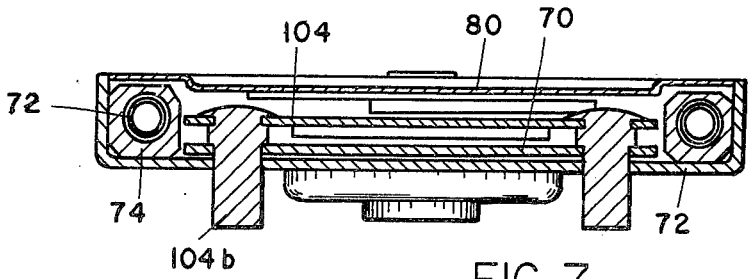
FIG. 7 is a sectional view taken on plane VII—VII of FIG. 3.
Figure 8:
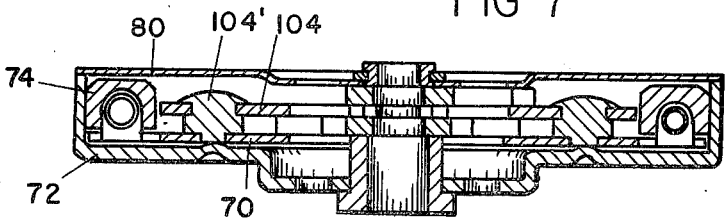
FIG. 8 is a sectional view taken on the planes VIII—VIII of FIG. 3.
Figure 9:
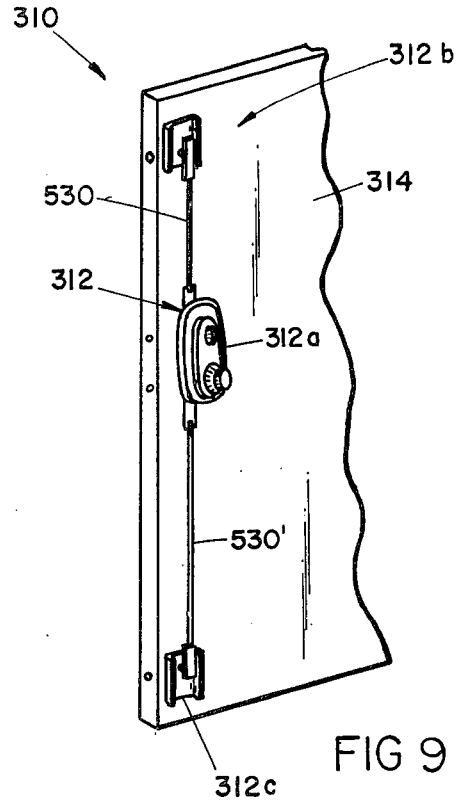
FIG. 9 is a perspective view of a second multiple bolt apparatus, in combination with a door.
Figure 11:
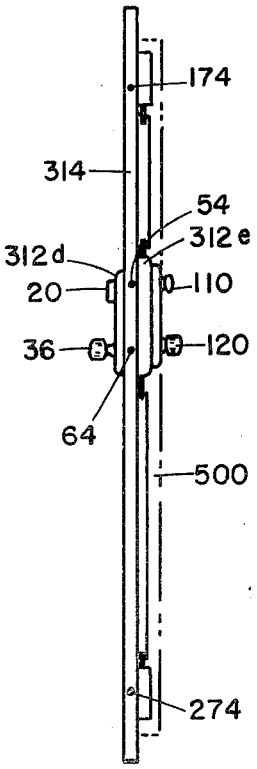
FIG. 11 is an edge elevational view of the apparatus in FIG. 10.
Figure 10:
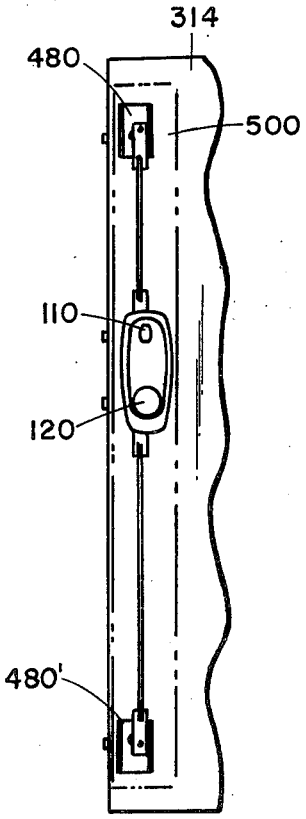
FIG. 10 is an elevational view of the apparatus in FIG. 9.
Figure 12:
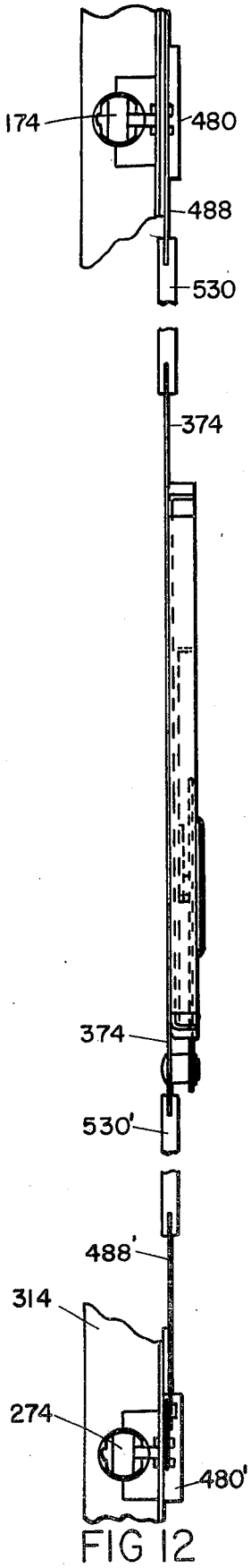
FIG. 12 is a fragmentary enlarged edge elevational view of portions of the assembly in FIG. 11.

Outer subassembly 12*d* is made up of the components depicted in FIG. 1*a*. More specifically, the outer subassembly includes a key lock cylinder and housing subassembly 20 of conventional type, operated by a key 24 and haing a rotational inwardly projecting tailpiece 22 as well as internally threaded attachment bosses 26, a conventional security ring 28, an escutcheon 30, a mounting plate 32 and a wire retainer 34. It also includes a hand operator or knob 36 with a solid spindle 38 projecting inwardly therefrom and an interconnecting axle 40, as well as a trim collar 42. Knob 36 can alternatively be a door pull and thumb latch actuator if desired. The key cylinder 20 and security ring 28 are cooperative with the upper opening 30' in escutcheon 30 and the upper opening 32' in mounting plate 32. Axle 40 and hub 38 of the outer knob 36 project through the opening in the trim collar 42 as well as lower opening 30'' in escuthcheon 30, and lower opening 32'' in mounting plate 32. Mounting plate 32 also has internally threaded mounting bosses 44. Tailpiece 22 of the cylinder lock projects through and cooperates with swivel 50 of conventional security deadbolt subassembly 52 which has a reciprocable deadbolt 54. Tailpiece 22 also projects through tailpiece driver bearing 51. This deadbolt subassembly is of a known type and may for example be like that in U.S. Pat. No. 3,799,592 incorporated by reference herein. Axle 40 of the outer knob projects through and cooperates with swivel 60 of the latch subassembly 62 which incorporates a latch bolt 64. This latch subassembly 62 may be of conventional type as for example that shown in U.S. Pat. No. 3,020,073, incorporated by reference herein. The deadbolt subassembly 52 and latch bolt subassembly 62 are both within the door itself, being located in door openings 66 and 68 respectively (FIG. 4).

Figure 1B:
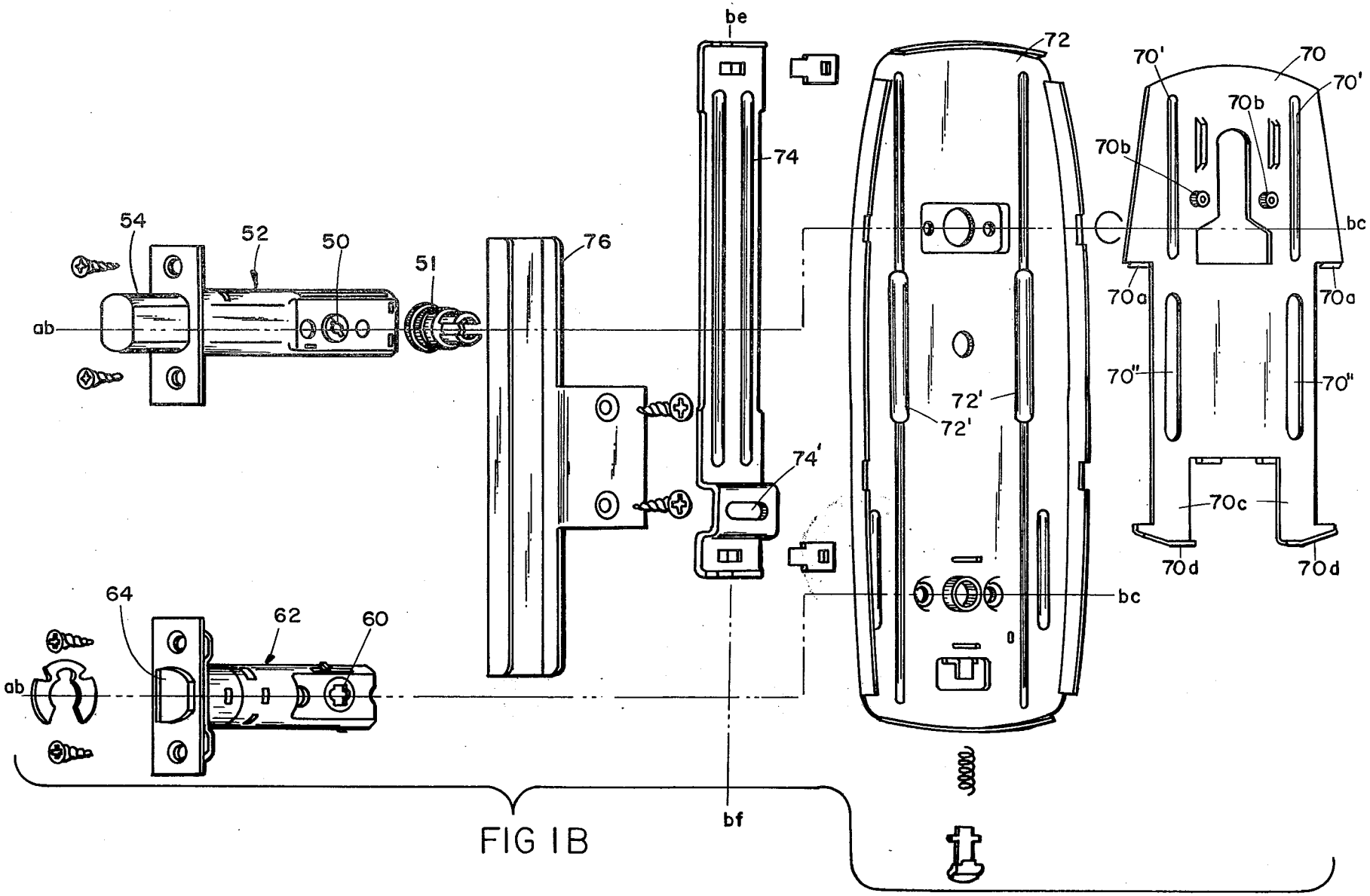
Figure 1C:
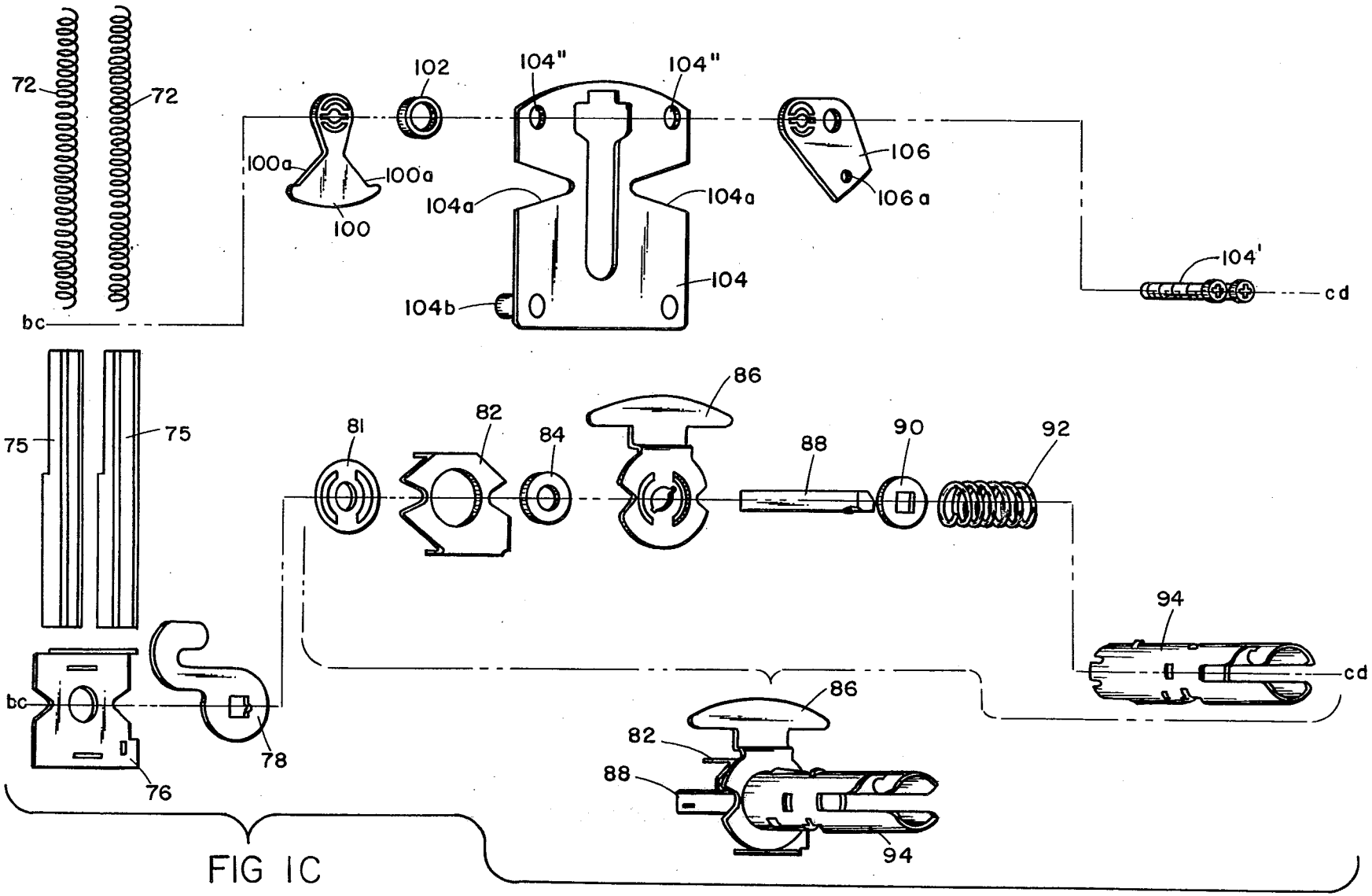
Figure 1D:
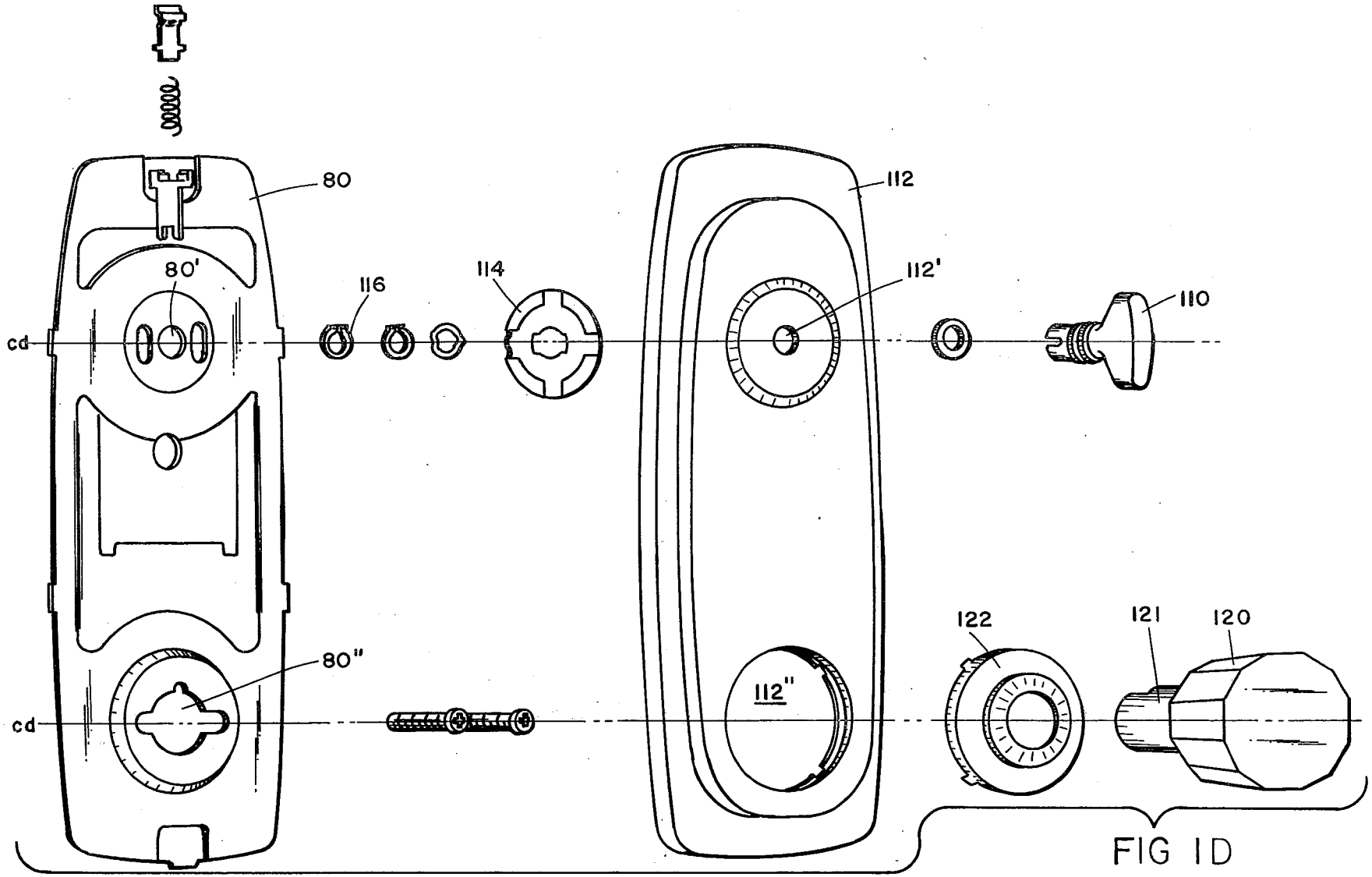

The inside subassembly portion 12*c* of the main central lock subassembly 12*a* includes the components depicted in FIG. 1*d*, those depicted in FIG. 1*c*, as well as the slide 70 and inner mount plate 72 depicted on FIG. 1*b*. The components in FIGS. 1*e* and 1*f*, as well as link slide 74 and guide channel 76 in FIG. 1*b* are located within the confines of the door 14 itself as will be understood from the description set forth hereinafter. Between inner mount plate 72 and cover 80 is located slide 70, slide springs 72, spring guides 75 for springs 72, sleeve base washer 76, latch driver 78, sleeve washer 81, sleeve base 82, spacer sleeve 84, quadrant cam 86, spindle 88, washer 90, spindle spring 92 and part of sleeve 94. Also between mount plate 72 and cover 80 is pivotal pendulum slide cam 100, spacer 102, auxiliary drive plate 104, and auxiliary drive plate cam 106. Thumb turn 110 projects through an opening 112' in escutcheon 112 and through spring washer 114 to be retained by retainer rings 116. Inner knob or hand actuator 120 has an axle 121 that projects through the opening in trim collar 122, the lower opening 112'' in escutcheon 112 and the lower opening 80'' in cover 80 to be in cooperative engagement with sleeve 94. Axle or spindle 40 of the outer knob projects into a correspondingly shaped opening in the outer part of conventional split swivel 60 of latch bolt assembly 62 such that rotation of the outer knob will rotate this part of the swivel and operate the latch bolt. The other half of the split swivel 60 is engaged by axle or spindle 88 of the inner knob to allow the inner knob to actuate the latch bolt.

Elongated tailpiece 22 of the outer cylinder 20 projects through the entire assembly to drivingly engage with swivel 50 of dead bolt latch assembly 52, slide cam 100, auxiliary drive plate cam 106, and through opening 80' in cover 80 to be in driving engagement with inner hand turn shown as a thumb turn 110.

Slide plate 70 reciprocates vertically, being biased upwardly by springs 72 which have their upper ends abutting slide shoulders 70*a* and their lower ends abutting against the closed lower ends of spring guides 74. Slide 70 includes a pair of bosses 70*b* on opposite sides of the vertical centerline of plate 70 for cooperatively engaging with one or the other of like diagonal camming surfaces 100*a* on opposite sides of slide cam 100. At the base of slide plate 70 is a pair of legs 70*c* with horizontal flanges 70*d* on the bottom thereof. The upper surfaces 70*d* are cooperable with quadrant cam 86 such that, when the cam 86 is rotated by sleeve 94, it will depress slide plate 70 against the bias of springs 72. This will occur only by rotation of the inner knob, in either direction. Latch driver 78 engages the lower surface of one of the flanges 70*d* to be rotationally driven by depression of slide 70, for rotation of spindle 88 which in turn operates the latch subassembly 62. In FIG. 1*c*, the components, 80–94 are also shown assembled at the bottom of the Figure for convenience.

Auxiliary drive plate 104 (FIG. 1*c*) employs a pair of laterally positioned outwardly divergent slots which have lower diagonal camming surfaces 104*a*, one of which is cooperatively engaged with a camming stud 106*a* on auxiliary drive plate cam 106. Thus, forced rotation of drive plate cam 106 by tailpiece 22 will cause auxiliary drive plate 104 to be vertically shifted downwardly. This drive plate employs a pair of aligning studs 104' through openings 104'' at the upper end thereof, which studs project into vertically elongated slots 70' of slide 70 to keep auxiliary drive plate 104 in alignment with slide plate 70. At the lower portion of drive plate 104 is another pair of studs 104*b* which project through elongated slots 70'' in slide plate 70, and slots 72' in mount plate 72, so that one of studs 104*b* can project into horizontally elongated slot 74' in vertically elongated link slide 74. If the door to which the assembly is attached is a right-hand door, the left stud 104*b* (as viewed in FIG. 1*c*) will be in slot 74', but if the door is a left-hand door, the other stud 104*b* will be in this slot, the structure being usable on either type of door.

Link slide 74 is positioned within a vertical cavity 14' (FIG. 4) of door 14, beneath the inner surface 14*a*. Door 14 is shown to be of the type having a wood périphery enclosed by surface sheets as of metal such as steel. Cavity 14' can be routed into the structure to form a vertically elongated cavity into which vertically elongated guide channel 76 (FIG. 1*b*) is mounted to receive vertically reciprocable slide plate 74, having its upper and lower ends connected to locking rods 130 and 230 respectively. The rods are alike, except in mirror image relationship. The lower end of locking rod 130 and the upper end of locking rod 230 include an enlarged head slidably interfitted with slots in the horizontal flanges of the upper and lower ends respectively of link slide 74. At the upper end of locking rod 130 and the lower end of locking rod 230, each has a smaller diameter portion engaged between a pair of cooperative clamping plates. More specifically, the upper end of rod 130 is securable between a fixed clamping plate 140 and an adjustable cover plate 142, while the lower end of rod 230 is secured between a fixed clamping plate 240 and an adjustable cover plate 242. Adjustable cover plate 142 is secured to plate 140 by a pair of screws 148 which fit through vertically elongated slots 150 into threaded openings 152 in plate 140. Cover plate 142 also includes a horizontally elongated slot 142' which receives the camming boss 154' of dog leg lever 154. On the opposite end of dog leg lever 154 is a second camming boss 154'' to enable the structure to be employed on a door of opposite hand. This lever is enclosed in the door between a cover 160 and a mounting cup 162 attached to the core of the door within the door. A horizontal tailpiece 166, retained in place by cover 160, extends through the like configurated central opening of lever 154, through the tailpiece bearing 168 and into the like configurated opening in swivel 170 of deadbolt subassembly 172. This deadbolt subassembly is of conventional type but is inverted to be operable by lever 154. With top quality deadlock subassemblies, the last one-eighth inch or so of throw of the deadlock bolt 174 causes the bolt to be nonretractable by axial force on the bolt itself. To assure full throw of the bolt for this purpose, the locking rod mechanism is capable of adjustment. This occurs by loosening of screws 148 and vertically sliding collar 142 relative to the shoulders on the smaller diameter upper end portion of locking rod 130. This movement causes camming slot 142' to shift camming stud 154' on lever 154, thus shifting the slot through which the tailpiece 166 projects, thereby rotatably shifting the swivel 170 of deadbolt subassembly 172 a controlled amount, and with it the deadbolt 174, to assure full throw of bolt 174 with activation of locking rod 130.

This auxiliary deadbolt lock subassembly in FIG. 1*e* is directly comparable to that of auxiliary subassembly in FIG. 1*f*. That is, the inverted locking rod 230 interengages between the fixed mounting collar 240 and the adjustable cover collar 242, with camming boss 254' of dog leg lever 254 being engaged in the horizontally elongated camming slot 242'. Tailpiece 266, retained in place by cover 260, extends through a like configurated slot in the center of lever 254, through an opening in the center of cup 262 and through tailpiece bearing 268 into the slot of swivel 270 of inverted, conventional deadbolt subassembly 272. Subassembly 272 has a deadbolt 274 for engagement with a cooperative deadbolt plate (not shown) in the door frame.

The three deadbolt subassemblies 52, 172 and 272, and the latch bolt subassembly 62 may all be known drive-in type rather than the mounting plate type as shown.

Operation of the novel assembly is such that all of the deadbolts can be thrown into extended locked position by rotation of the inner turnpiece 110 or alternatively, by rotation of the key lock cylinder 20. Operation of the latch subassembly 62 can be effected by actuation of the inner knob 120 or outer knob 36. Unlocking, i.e. simultaneous retraction, of all of the deadbolts, can be effected by the key lock cylinder 20, the inner turnpiece 110, or the inner knob 120. Simultaneous retraction of all of the deadbolts and the latch can be achieved only by rotation of inner knob 120.

Each of these will now be explained more specifically.

Rotation of cylinder lock 20 by key 24 will rotate tailpiece 22. It rotates swivel 50 of deadlock 52 to retract deadbolt 54, and rotates auxiliary drive plate cam 106 (FIG. 1*c*), such that cam boss 106*a* on this plate engages the diagonal tapered surface 104*a* on auxiliary drive plate 104 to depress it. Depression of plate 104 causes its protruding stud 104*b*, which is engaged in slot 74' of link slide 74 (FIG. 1*b*), to depress the link slide. This causes the locking rods 130 and 230 to be lowered, to thereby pivot the levers 154 and 254 for rotation of tailpiece 166 and tailpiece 266 by cams 154' and 254' in slots 242 and 242'. Levers 154 and 254 move through about an angle of about 120° such that the lower leg in FIG. 5 moves to where the upper leg is in shifting rod 130 up to the phantom line position depicted, while the upper leg shifts over to the other side as set forth in phantom lines. These tailpieces 166 and 266 operate upon the respective swivels 170 of deadlock 172 and 270 of deadlock 272. Thus, all three deadlock bolts are retracted simultaneously. Operation of the key cylinder in the opposite direction will throw all of the deadlocks into the extended locked condition by reverse movement of the components just described. During the vertical motion of the link slide, it is maintained in proper lateral orientation by the guide channel 76. And, if it is determined that either or both deadbolts 174 and 274 are not being sufficiently thrown so as to be in the nonrepressable condition, adjustment can be readily made. Adjustment of the upper deadbolt throw is achieved by loosening screws 148 (FIG. 1*e*) and sliding this plate vertically so that slot 142' shifts cam 154 a small controlled amount to thereby rotate tailpiece 166 and swivel 170 for full throw of the deadbolt. Like adjustment can be made in the lower deadbolt 272.

Operation of all the deadbolts by the inner turnpiece of thumb turn 110 is comparable to operation thereof by cylinder lock 20. That is, operation of thumb turn 110 results in rotation of elongated tailpiece 22 extending between cylinder lock 20 and thumb turn 110, to rotate cam 106 in the manner previously described, and also to rotate swivel 50 of deadlock 52 in the manner previously described. Thus, operation of the thumb turn can be used to retract the deadbolts simultaneously, or by turning it in the opposite direction, to extend the deadbolts simultaneously.

Actuation of outer knob 36 will operate only latch bolt 62. Specifically, the axle 40 on knob 36 extends into one side of the like configurated swivel 60 of the latch 62 to retract the latch bolt 64. It does not operate the deadbolts, however.

All three of the deadbolts and the latch bolt may be retracted simultaneously by operation of the inside knob 120, as for panic exit. More specifically, rotation of the knob 120 causes rotation of sleeve 94 and, by its interengagement with quadrant cam 86, causes rotation of the quadrant cam. Quadrant cam engages the upper surface of flanges 70*d* (FIG. 3) of slide 70 such that rotation of the quadrant cam in one direction or the other will depress one of these flanges to drive the slide downwardly. Downward movement of the slide forces rotation of latch driver 78 (FIG. 1*c* and 3) which rotates spindle 88 that interengages therewith, this spindle also extending into swivel 60 of latch 62 to operate the latch. Simultaneously with operation of the latch, the downward movement of slide 70 causes one of its embossments 70*b* to engage one of the diagonal surfaces 100*a* of pivotal pendulum slide cam 100 (FIG. 1*c*). This shifts it downwardly to its central neutral position, thereby rotating tailpiece 22 for retracting lock bolt 54 of lock bolt subassembly 52 by rotating swivel 50. Rotation of tailpiece 22 also causes cam 106 to rotate, with its projection 106*a* engaging surface 104*a* of element 104 to depress element 104, thus causing its stud 104*b* which engages with slot 74' to lower the link slide 74 in the manner previously described. This causes downward shifting of locking rods 130 and 230 to retract the deadbolt mechanisms 172 and 272, thereby causing simultaneous retraction of all three deadbolts as well as the latch bolt.

Referring now to the apparatus depicted in FIGS. 9–13, the assembly 310 includes a lock assembly 312 mounted on the inside face of a door 314 that includes a typical door frame (not shown).

For convenience, the elements of the structure in FIGS. 9–13 that are identical to those elements in the structure in FIGS. 1–8 will be given the same reference numerals.

Lock assembly 312 includes a main central lock subassembly 312*a* and auxiliary lock subassemblies 312*b* and 312*c* such that the three subassemblies are opposite the three hinges (not shown) of the door. Main lock subassembly 312*a* includes an inner subassembly 312*e* and an outer subassembly 312*d* on the respective inside and outside faces of door 314. Outer subassembly 312*d* has a key lock cylinder and housing 20 of conventional type, and an outer hand operator or knob 36. This knob can be a door pull and thumb actuator, e.g. a handle set, if desired. This manner subassembly includes hand operator or knob 120 and an inner turnpiece or thumb turn 110. The central lock subassembly includes a latch 64 and latch assembly like that at 62, (FIG. 1*b*), and a deadbolt 54 and deadbolt assembly like that at 52 (FIG. 1*b*). The latch bolt subassembly and deadbolt subassembly are mounted within the door itself in conventional fashion.

Further, the upper auxiliary lock subassembly includes a deadbolt 174 of a deadbolt subassembly identical to that at 172 (FIG. 1*e*). The lower auxiliary deadbolt 274 has a deadbolt subassembly identical to that at 272 (FIG. 1*f*). Deadbolts 174 and 274 are mounted into the door.

Mounted to the inside face of door 314 at each of the upper and lower auxiliary deadbolt subassemblies is a pair of respective channel-shaped brackets 480 and 480', each having a flat plate and a pair of projecting edge flanges. Within the space between the flanges is a pair of respective pivot cams 482 and 482'. These cams are mounted to the swivel mechanism for the respective auxiliary deadbolt subassemblies such that, with arcuate rotational shifting of the cams in one direction or the other rotates the swivels arcuately to cause the deadbolts to be extended or retracted. Each of these cams includes a projecting stud 484 and 484' offset from the rotational axis of the cam, and fitting within respective horizontal slots 486 and 486' of a pair of slide plates 488 and 488'. These slide plates are caused to shift vertically in a manner to be explained, and are restrained against lateral movement in one direction by flanges of brackets 480 and 480', and in the other direction by contact with the pin for the cams 482 and 482'. Plates 488 and 488' are the upper and lower extremities of a vertical tie rod assembly that includes a pair of rods 530 and 530' connecting upper and lower plates 488 and 488' respectively with the upper and lower ends of a central link slide 374. This tie rod assembly is vertically shifted by an auxiliary drive plate cam 406.

More specifically, cam plate 406 is mounted to pivot on tailpiece 22 extending between cylinder lock 20 and thumb turn 110. Cam 406 has a boss or stud 406*a* offset from the cam pivot axis, and fitted into a horizontal slot 404' of an auxiliary drive plate 404. Plate 404 has a boss or stud 404*a* that projects into an opening in link slide 374. Thus, pivoting of cam 406 shifts plate 404 which in turn shifts slide 374 to shift rods 530 and 530'. These rods shift plates 488 and 488' to pivot cam s482 and 482' for extending or retracting the auxiliary deadbolts 172 and 272.

The central lock subassembly, except for cam 406 in place of cam 106, auxiliary drive plate 404 in place of plate 104, and link slide 374 in place of link slide 74, is comparable to that in FIGS. 1–8. Thus, the lock arrangement includes a quadrant cam 86, a latch driver 78, slide springs 72 and spring guides 74 and so forth.

With this structure, operation of the thumb turn 110 or the lock cylinder 120 will rotate tailpiece 22 (FIG. 13) which operates cam 406 to depress link slide 374 and with it, rods 530 and 530' and plates 488 and 488' to retract the auxiliary deadbolts 174 and 274, simultaneously tailpiece 22 operating cam 100 to shift the deadbolt of the main lock subassembly.

Operation of the outer knob 36 will actuate only latch 64. Operation of the inner knob 120 will simultaneously retract the latch and also all of the deadbolts.

That is, rotation of inner knob 120 will rotate its sleeve and quadrant cam 86. It engages flange 70*d* of slide 70 to depress slide 70 to rotate latch driver 78 which rotates spindle 88. Spindle 88 rotates the latch swivel. Slide 70 also rotates slide cam 100 to rotate tailpiece 22 to operate cam plate 406 and thereby operate the auxiliary deadbolts in the fashion just described.

The apparatus in FIGS. 9–13 can be mounted to a door already in use. It does not require the presence of a vertical space in the door as does the apparatus in FIGS. 1–8. However, it might be objectionable to some persons to mount the mechanism on the inside door face. A decorative housing 500 shown in phantom in FIGS. 10 and 11 can be attached to the door to improve the appearance.

It is conceivable that certain details of the apparatus depicted could be modified to suit a particular style door. The invention therefore is that set forth in the attached claims rather than as illustrated in detail.

The embodiments of the invention in which an exclusive property or privilege is claimed are defined as follows:

1. A panic exit, multiple deadbolt, interconnecting door lock assembly comprising:

a main lock subassembly including a latch bolt reciprocable between extended and retracted positions, a main lock security deadbolt reciprocable between extended and retracted positions, an outer hand operator, an inner hand operator, and an inner turnpiece; auxiliary lock subassemblies spaced from said main lock subassembly and each including a security deadbolt reciprocable between extended and retracted positions; first means for operably connecting said outer hand operator only to said latch bolt for reciprocating said latch bolt; second means for connecting said inner turnpiece to said main lock subassembly security deadbolt and to said auxiliary lock subassembly security deadbolts to simultaneously reciprocate all of said deadbolts, and including a rotational tailpiece; and third means for connecting said inner hand operator to said latch bolt and to all of said security deadbolts, to simultaneously reciprocate all of said deadbolts and said latch bolt; said third means including a vertically shiftable slide; a driver cam connected to said inner hand operator to be operated thereby, and in engagement with said slide to vertically shift said slide when operated by said inner hand operator; a one way drive latch driver engaged by said slide to retract said latch bolt; and a shiftable driven cam operably engaged with said slide to be shifted thereby; said main lock subassembly including a swivel to said main lock security deadbolt, said rotational tailpiece projecting through said swivel and through said driver cam to retract said main lock security deadbolt with vertical shifting of said slide; an auxiliary drive plate cam on said tailpiece to rotate therewith, and an auxiliary shiftable drive plate connected to said auxiliary drive plate cam to be shifted thereby and also connected to said reciprocable connecting means to said auxiliary lock subassemblies, to enable panic exit with retraction of all of said deadbolts by operation of just said inner hand operator which shifts said driven cam, to shift said vertically shiftable slide and thereby shift said driven cam, said rotational tailpiece, said main lock deadbolt swivel and also said auxiliary drive plate cam, and thereby said auxiliary drive plate, and said reciprocable connecting means to retract said auxiliary lock deadbolts.

2. The multiple deadbolt lock assembly in claim 1 wherein said connecting means, said cam mechanism, and said auxiliary deadbolts are adjustable relative to said main lock subassembly, to enable assured throw of said auxiliary deadbolts to the fully extended position.

3. The multiple deadbolt lock assembly in claim 1 wherein said reciprocable connecting means includes a reciprocable link slide, and said assembly includes a guide channel for said link slide to retain said link slide laterally during vertical reciprocation thereof.

4. The assembly in claim 1 wherein said auxiliary lock subassemblies comprise a pair of such subassemblies located above and below said main lock subassembly and being inverted relative to said main lock subassembly security deadbolt.

5. The panic exit door lock assembly in claim 1 including an elongated opening in said slide, said tailpiece projecting through said elongated opening to said auxiliary drive plate cam.

* * * * *

UNITED STATES PATENT AND TRADEMARK OFFICE

CERTIFICATE OF CORRECTION

PATENT NO. : 4,156,541

DATED : May 29, 1979

INVENTOR(S) : John H. Babb, Jr., et al

It is certified that error appears in the above-identified patent and that said Letters Patent are hereby corrected as shown below:

Column 4, line 14:

After "surfaces" insert ---of flanges---

Column 7, line 22:

"manner" should be ---inner---

Column 8, line 1:

"cam s482" should be ---cams 482---

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*